US005746624A

United States Patent [19]

Ohsumi et al.

[11] Patent Number: 5,746,624

[45] Date of Patent: May 5, 1998

[54] CONNECTOR ALLOWING PLAY

[75] Inventors: Hideki Ohsumi; Yoshinori Tomita, both of Shizuoka, Japan

[73] Assignee: Yazaki Corporation, Tokyo, Japan

[21] Appl. No.: 640,106

[22] Filed: Apr. 30, 1996

[30] Foreign Application Priority Data

May 2, 1995 [JP] Japan ..... 7-108407

[51] Int. Cl.[6] ..... H01R 13/422

[52] U.S. Cl. ..... 439/595

[58] Field of Search ..... 439/595, 752

[56] References Cited

U.S. PATENT DOCUMENTS 4,944,695 7/1990 Tsuji et al. ..... 439/595
4,944,696 7/1990 Sueyoshi et al. ..... 439/595
4,969,841 11/1990 Sueyoshi et al. ..... 439/595
5,108,309 4/1992 Oda et al. ..... 439/595
5,622,521 4/1997 Marceau et al. ..... 439/595

*Primary Examiner*—Gary F. Paumen
*Attorney, Agent, or Firm*—Morgan, Lewis & Bockius LLP

[57] ABSTRACT

A connector comprising a connector housing including a terminal accommodating chamber configured to receive a terminal fitting and a cantilevered flexible retaining arm extending from an inner wall surface of the terminal accommodating chamber, the flexible retaining arm having a first recessed surface, and a terminal retainer including an insertion portion configured to receive a mating terminal for the terminal fitting and a spacer, the spacer having a second recessed surface. When the terminal retainer is connected to the connector housing and the terminal fitting is completely inserted into the terminal accommodating chamber, the first and second recessed surfaces are in a confronting relationship to allow for a play of the terminal fitting.

10 Claims, 5 Drawing Sheets

CONNECTOR ALLOWING PLAY

BACKGROUND OF THE INVENTION

1. Field of the Invention

The present invention relates to connectors that are used for connecting wire harnesses and the like, and more particularly, to a connector with a terminal retainer for sensing half-insertion of a terminal fitting that has been inserted into a terminal accommodating chamber of a connector housing.

2. Discussion of the Related Art

In general, to retain a terminal fitting inserted into a terminal accommodating chamber of a connector housing lest the terminal fitting should come off rearward, a flexible retaining arm is arranged integrally with the inner wall of the accommodating chamber and the flexible retaining arm is allowed to be engaged with a terminal fitting that has been completely inserted into the accommodating chamber. However, a recently proposed structure is characterized as assembling a terminal retaining member to either the front or the rear of the connector housing. This structure attempts more reliably to prevent the terminal fitting from coming off through the retaining member either together with the flexible retaining arm or in place of the flexible retaining arm.

FIG. 7 shows an example of such a conventional retaining structure wherein a flexible retaining arm d projects so as to extend integrally from an inner wall c of a terminal accommodating chamber b in a connector housing a. As shown in the lower half of FIG. 7, the thus constructed retaining structure prevents a terminal fitting e from coming off rearward by engaging a terminal retaining portion $d_1$ on a free end of the flexible retaining arm d with a shoulder portion $e_1$ of the terminal fitting e that is in the completely inserted condition. Further, a spacer g of a terminal retainer f advances into a displacement allowing space V of the flexible retaining arm d arranged between the flexible retaining arm d and the inner wall c to thereby block the displacement of the flexible retaining arm d. As a result of the spacer g, the retaining force with respect to the terminal fitting e can be reinforced.

On the other hand, when the terminal fitting e is in the half-inserted condition, the flexible retaining arm d rides over the terminal fitting e as shown in the upper half of FIG. 7 and remains displaced toward the inner wall c in the displacement allowing space V. Therefore, a terminal pressing protuberance $d_{11}$ and a half-insertion sensing portion $g_1$ of the spacer g collide against each other to keep the terminal retainer f from being inserted. As a result, the half-insertion of the terminal fitting e can be sensed.

However, the size of the terminal accommodating chamber b and the displacement allowing space V of the connector cannot be fully increased because the needs for downsizing the connector must also be satisfied. Further, with respect to the dimensions of respective parts of the connector housing a, tolerances must be considered in plastic molding the connector housing a. As a result of such tolerances not being met, even if the terminal fitting e is in the half-inserted condition, a flexible retaining arm d' such as shown in the upper half of FIG. 8 does allow the spacer g to advance into the displacement allowing space V, and this may disadvantageously prevent the terminal retainer f from reliably performing the function of sensing the half-inserted condition of the terminal fitting e.

In order to avoid such disadvantages, it is conceivable to move a shaded portion S of a flexible retaining arm d" (see FIG. 9) in a direction indicated by the arrow Z, e.g., by increasing the thickness t of the flexible retaining arm d", toward the inner wall c or toward the displacement allowing space V so that the advancement of the spacer g can be reliably blocked when the terminal fitting e is in the half-inserted condition as shown in the upper half of FIG. 8.

However, as shown in FIG. 10, the flexible retaining arm d" having the aforementioned thickness strongly pushes down on the terminal fitting e as indicated by the broken line as a result of the spacer g having been inserted, which completely eliminates vertical play of the terminal fitting e within the terminal accommodating chamber b. Thus, the terminal fitting e does not join suitably with a mating male terminal fitting (not shown) when the connector is being connected. As a result, this structure has imposed the problem that stable contact is lost due to the terminal play in the axial directions or that the connecting force of the connector is increased.

SUMMARY OF THE INVENTION

Accordingly, the present invention is directed to a connector that substantially obviates one or more problems due to limitations and disadvantages of the related art.

An object of the invention is to provide a connector with a terminal retainer of such structure that half-insertion of a terminal can be reliably sensed without losing stable contact of the terminal and without increasing the connecting force of the connector.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and the other advantages and in accordance with the purpose of the present invention, as embodied and broadly described, a connector is provided which includes a connector housing having a terminal accommodating chamber, a terminal fitting inserted into the terminal accommodating chamber, and a terminal retainer assembled to a front portion of the connector housing. The terminal accommodating chamber has a cantilevered flexible retaining arm so as to extend integrally from an inner wall of the terminal accommodating chamber with a displacement allowing space interposed between the flexible retaining arm and the inner wall surface. The flexible retaining arm has a terminal retaining portion on a free end thereof. The terminal retainer further has an insertion portion and a spacer. The insertion portion serves to allow a mating terminal for the terminal fitting to be inserted thereinto. The spacer extends between the inner wall surface and the flexible retaining arm that has engaged with the terminal fitting in a completely inserted condition. The spacer also has a terminal fitting half-insertion sensing portion on a free end thereof. In such a connector, a half-insertion sensing portion releasing portion is arranged on a surface of the flexible retaining arm and a terminal retaining stepped portion releasing portion is arranged on a surface of the spacer, both surfaces confronting each other, so that the terminal fitting has a play in an inner wall surface direction within the terminal accommodating chamber when the terminal retainer is regularly connected.

The half-insertion sensing portion, releasing portion, and terminal retaining stepped portion releasing portion are arranged on a surface of a flexible retaining arm and a surface of a spacer, respectively, the arm and the spacer mating with each other and both surfaces confronting each other. As a result of this construction, the thickness of the flexible retaining arm and that of the spacer can be substantially increased without changing the nominal thicknesses thereof.

To further achieve these and the other advantages and in accordance with the purpose of the present invention, as embodied and broadly described, a connector is provided comprising a connector housing including a terminal accommodating chamber configured to receive a terminal fitting and a cantilevered flexible retaining arm extending from an inner wall surface of the terminal accommodating chamber, the flexible retaining arm having a first recessed surface; and a terminal retainer including an insertion portion configured to receive a mating terminal for the terminal fitting and a spacer, the spacer having a second recessed surface, wherein, when the terminal retainer is connected to the connector housing and the terminal fitting is completely inserted into the terminal accommodating chamber, the first and second recessed surfaces are in a confronting relationship to allow for a play of the terminal fitting.

In one aspect, the first recessed surface is a first stepped recessed surface and wherein the second recessed surface is a second stepped recessed surface.

In another aspect, the first recessed surface is a first tapered recessed surface and wherein the second recessed surface is a second tapered recessed surface, wherein the first tapered recessed surface slopes downward from a free end of the flexible retaining arm toward a fulcrum of the flexible retaining arm and wherein the second tapered recessed surface slopes upward from a fixed end of the spacer toward a free end of the spacer.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

In general, the present invention reliably prevents half-insertion of a terminal without losing stable contact of the terminal and without changing the connecting force of a connector by improving not only a flexible retaining arm in a terminal accommodating chamber of the connector but also a spacer of a terminal retainer that is inserted into the front of the connector. Specifically, a cantilevered flexible retaining arm having a flexible retaining stepped portion is arranged in a terminal accommodating chamber of a connector housing. The flexible retaining arm extends integrally from an inner wall surface while interposing a displacement allowing space between the flexible retaining arm and the inner wall surface. A terminal retainer is assembled to the connector housing from the front of the housing, and has a spacer that extends between the flexible retaining arm and the inner wall surface when assembled. The spacer has half-insertion sensing portion on a free end thereof. A half-insertion sensing portion releasing portion and a terminal retaining stepped portion releasing portion are arranged on a surface of the flexible retaining arm and a surface of the spacer, such that both surfaces confront each other. As a result of these releasing portions, a terminal fitting is provided with a play in a direction of the inner wall surface within the terminal accommodating chamber when the terminal retainer is regularly connected to the connector housing.

Figure 1:
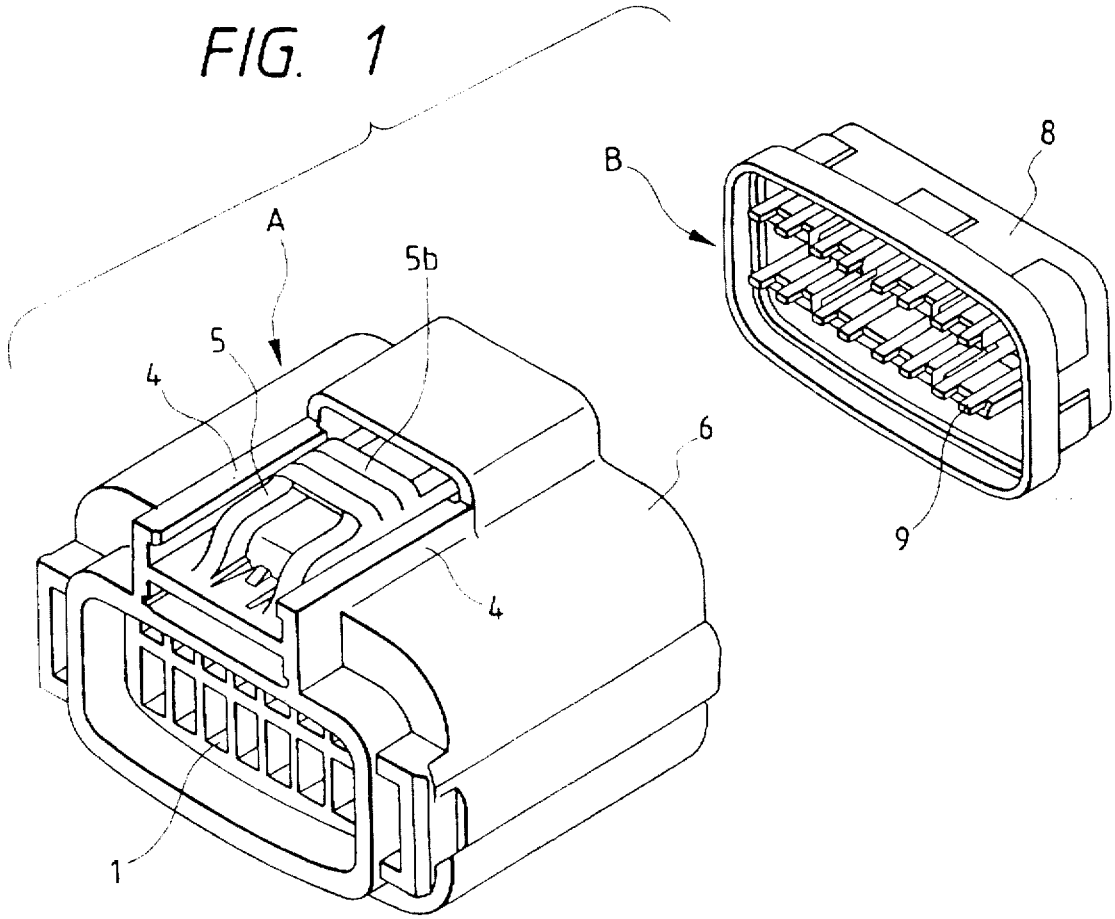
FIG. 1 is a perspective view of an embodiment of the invention with a male connector housing separated from a terminal retainer therefor.
Figure 2:
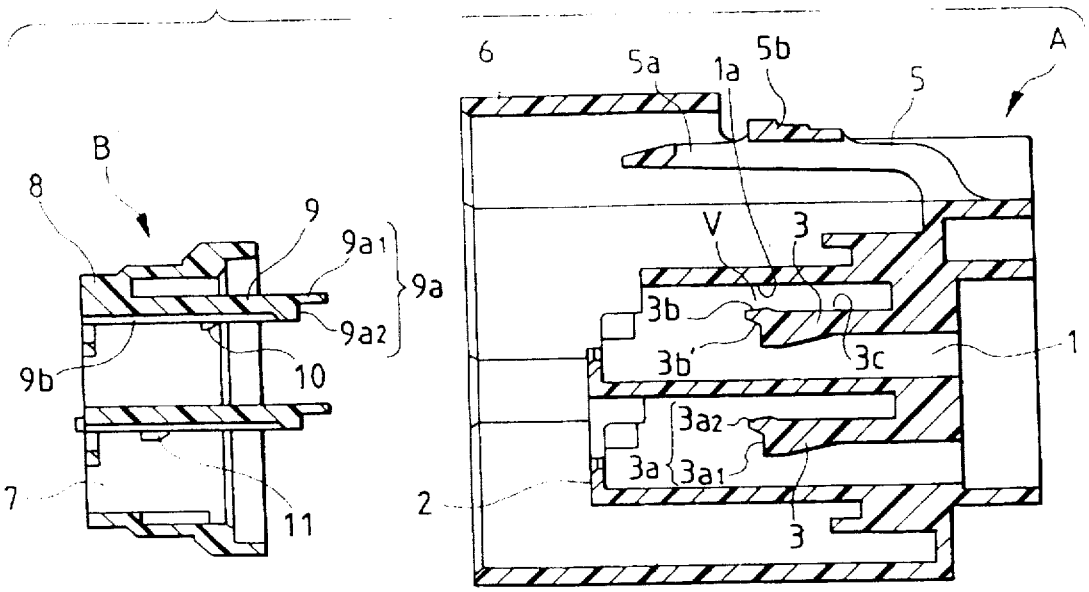
FIG. 2 is a sectional of the male connector housing and the terminal retainer of FIG. 1.
Figure 3:
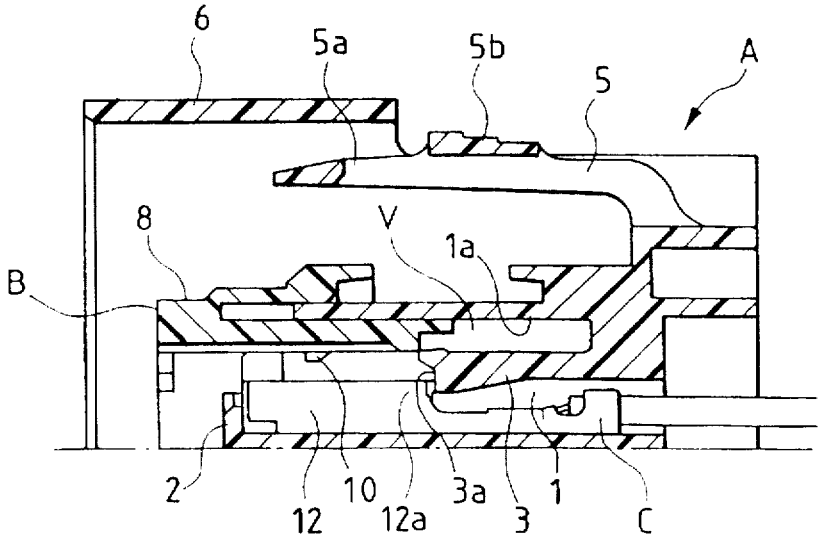
FIG. 3 is a partial sectional view of the terminal retainer in the temporarily connected condition.

In FIGS. 1 and 2, reference character A denotes a male connector housing, which may be made of synthetic resin, for example. A terminal retainer B, which is a separate piece, is connected to the front of the male connector housing A. The terminal retainer B may be made of a synthetic resin, for example. A plurality of terminal accommodating chambers 1 are vertically juxtaposed in two steps, and a female terminal fitting C is inserted into a terminal accommodating chamber 1 as shown in FIG. 3.

A stopper 2 is arranged at the front end of each terminal accommodating chamber 1. A cantilevered flexible retaining arm 3 is formed integrally with an inner wall surface 1*a* while interposing a displaceable space V with respect to the inner wall surface 1*a*. Further, on the upper surface of the connector housing A are protecting walls 4 confronting each other and a cantilevered flexible locking arm 5. The flexible locking arm 5 has a locking hole 5*a* and an operation portion 5*b*. Still further, a watertight hood 6 is provided over a mating female connector housing (not shown) and arranged around the outer periphery of the connector housing A.

The terminal retainer B includes a framelike main body portion 8 and spacers 9. The spacers 9 project so as to correspond to the plurality of terminal accommodating chambers 1 that are vertically juxtaposed in two steps. The spacers 9 extend from the framelike main body portion 8 toward the rear of the framelike main body portion 8. The framelike main body portion 8 has therein insertion portions 7 that allow mating male terminals (not shown) corresponding to the female terminal fittings C to be inserted thereinto. A temporarily retaining protuberance 10 and a regularly retaining protuberance 11 with respect to the connector housing A are arranged on the inner peripheral surface of the framelike main body portion 8.

The flexible retaining arm 3 in each terminal accommodating chamber 1 has on a free end thereof a retaining stepped portion 3*a* that includes a terminal receiving portion 3*a*, and a terminal pressing portion $3a_2$. The terminal pressing portion $3a_2$ serves also as a double retainment sensing portion. The terminal pressing portion $3a_2$ is tapered off to form tapered guide portions 3*b* and 3*b*' on both upper and lower surfaces thereof. The upper tapered guide portion 3*b* in particular is given a largest possible inclination. Further, a stepped-down releasing portion 3*c*, which is one step recessed with respect to the terminal pressing portion $3a_2$ is arranged on the upper surface of the flexible retaining arm 3, i.e., on a surface confronting the inner wall surface 1*a*.

On the other hand, a half-insertion sensing portion 9*a*, including a projecting piece $9a_1$ and a half-insertion sensing surface $9a_2$, is arranged on the free end of each spacer 9. Further, a stepped-down releasing portion 9*b*, which is one step recessed with respect to the lower end of the half-insertion sensing surface $9a_2$, is also formed on the lower surface of the spacer 9, i.e., on a surface confronting the flexible retaining arm 3. By arranging the stepped-down releasing portions 3*c* and 9*b* on the surfaces at which the flexible retaining arm 3 confronts the spacer 9, respectively, the thickness of the flexible retaining arm 3 and that of the spacer 9 are substantially increased without changing the nominal thicknesses thereof.

In the aforementioned construction, the connector housing A and the terminal retainer B are in the temporarily connected condition as shown in FIG. 3 with the temporarily retaining protuberance 10 of the framelike main body portion 8 engaging with a retaining protuberance (not shown) arranged within the connector housing A before a terminal fitting C is inserted. Under this condition, a terminal fitting C is inserted into a terminal accommodating chamber 1 from the rear of the connector housing A. In this operation, the terminal fitting C advances while causing the flexible retaining arm 3, which is in such a position as to interfere with the terminal fitting C, to be flexibly displaced upward as viewed in FIG. 3 against the resiliency thereof through the flexible displacement allowing space V on the inner wall surface 1*a* side. When an electrical contact portion 12 of the female terminal fitting C has passed over the flexible retaining arm 3, a shoulder portion 12*a* of the female terminal fitting C engages with the retaining stepped portion 3*a* in the completely inserted position. Such engagement prevents the terminal fitting C from coming out from the rear of the connector housing.

Figure 4:
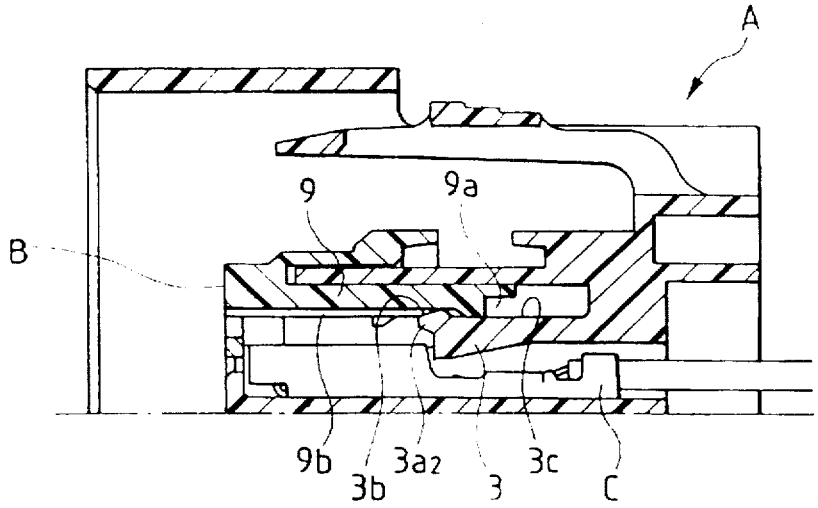
FIG. 4 is a partial sectional view of the terminal retainer in the regularly connected condition.

When, as shown in FIG. 4, the terminal retainer B is further pushed into the connector housing A, the regularly retaining protuberance 11 engages with a retaining protuberance (not shown) in FIG. 4 within the housing. As a result of the engagement, the terminal retainer B is regularly connected to the connector housing A. During the pushing operation, the spacer 9 advances while pushing the flexible retaining arm 3 further downward toward the terminal fitting C with the lower end surface of the half-insertion sensing portion 9*a* in the end of the spacer 9 coming in slidable contact with the tapered guide portion 3*b* of the terminal pressing portion $3a_2$. When the spacer 9 has passed over the terminal pressing portion $3a_2$, the flexible retaining arm 3 returns resiliently. However, since the stepped-down releasing portions 3*c* and 9*b* are formed on the confronting surfaces of the flexible retaining arm 3 and the spacer 9, the releasing portion 3*c* of the flexible retaining arm 3 does not block the advancement of the spacer 9, but instead allows the spacer 9 to advance, which in turn allows the terminal retainer B to be regularly connected to the connector housing A smoothly. Further, the flexible retaining arm 3 is provided with some room for making a slight resilient vertical displacement owing to the stepped-down releasing portions 3*c* and 9*b*, such that a space is provided for accommodating vertical play of the terminal fitting C.

Figure 5:
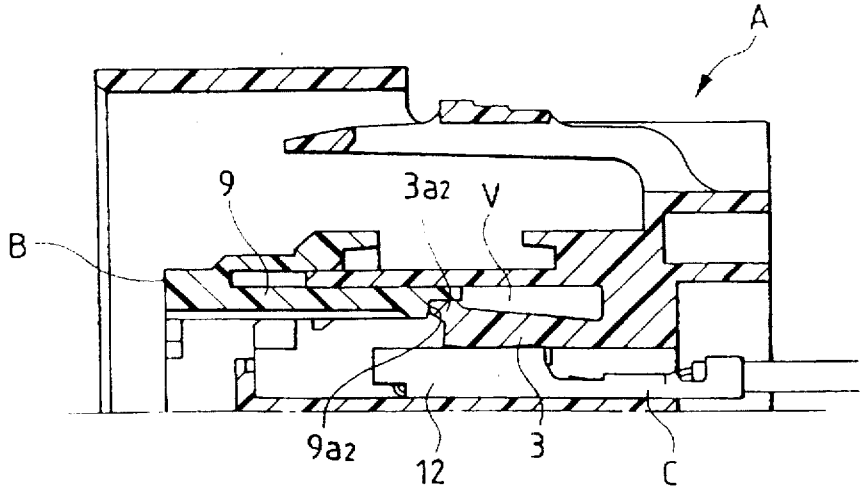
FIG. 5 is a partial sectional view of the terminal retainer detecting the half-inserted condition of a terminal fitting.

On the other hand, when the terminal fitting C is in the half-inserted condition, the flexible retaining arm 3 rides over the electrical contact portion 12 to substantially close the flexible displacement allowing space V as shown in FIG. 5. That is, the retaining stepped portion 3*a* of the terminal pressing portion $3a_2$ in the flexible retaining arm 3 collides against the half-insertion sensing surface $9a_2$ of the spacer 9, which blocks the spacer 9 from being inserted and therefore does not allow the terminal retainer B to be regularly connected to the connector housing A as shown in FIG. 4. As a result, the half-inserted condition of the terminal fitting C can be sensed.

Figure 6A:
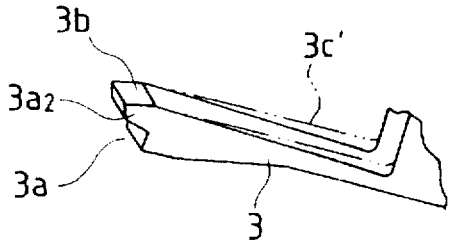
FIG. 6(A) is a perspective view of a flexible retaining piece in another embodiment of the invention.
Figure 6B:
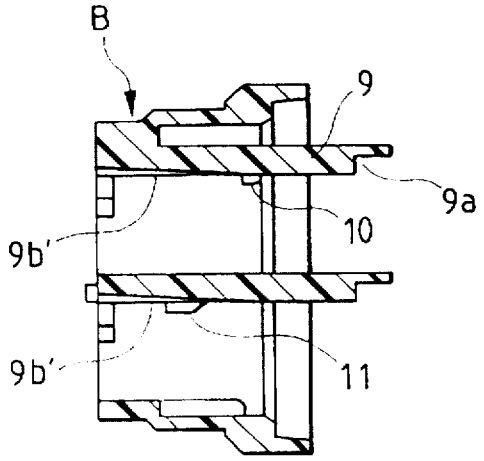
FIG. 6(B) is a sectional view of a terminal retainer corresponding to the flexible retaining piece.
Figure 7:
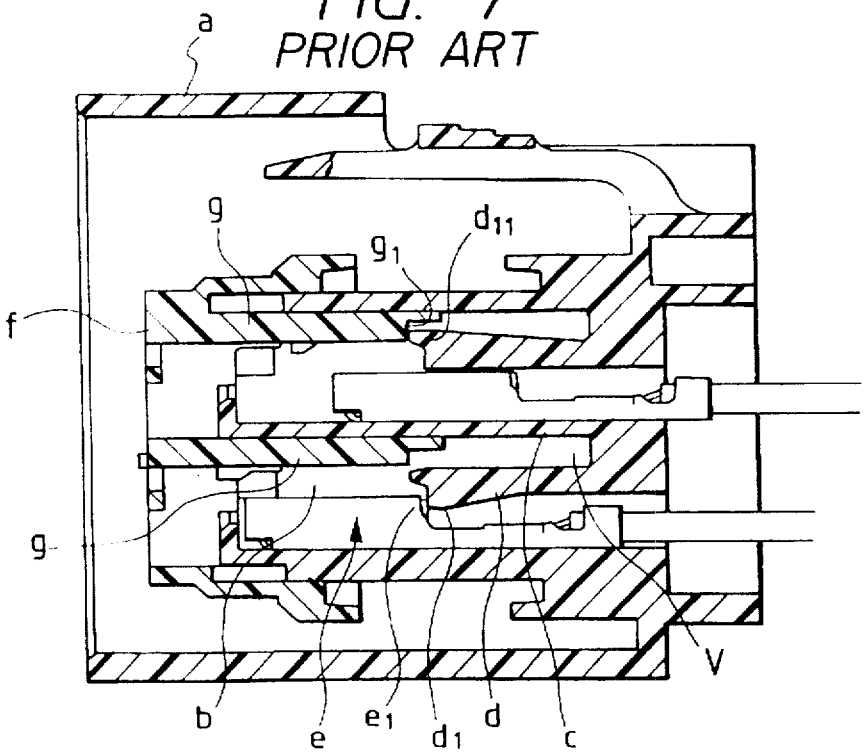
FIG. 7 PRIOR ART
FIG. 7 is a sectional view of a male connector housing temporarily connected to a terminal retainer in a conventional example.
Figure 8:
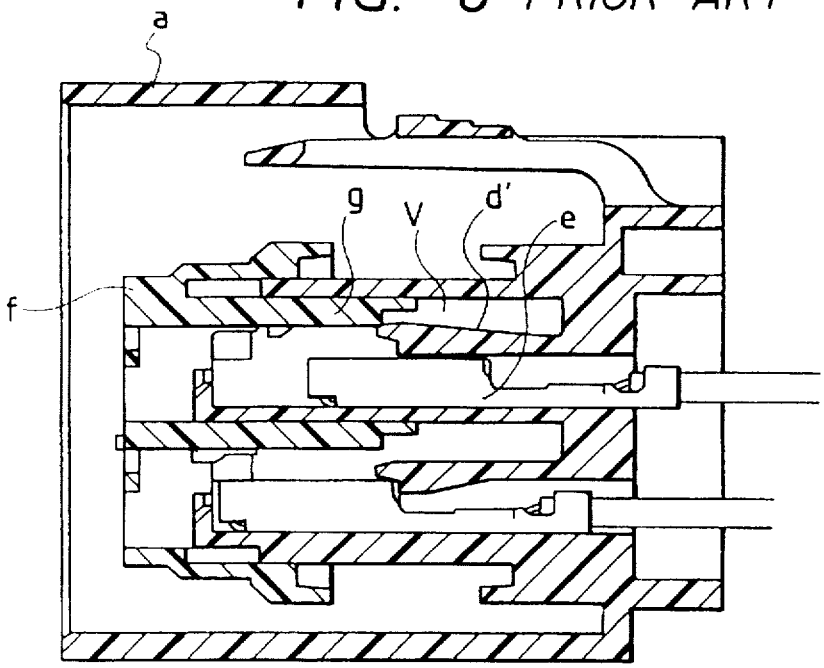
FIG. 8 PRIOR ART
FIG. 8 is a sectional view of an example in which the terminal retainer cannot detect the half-inserted condition of a terminal fitting.
Figure 9:
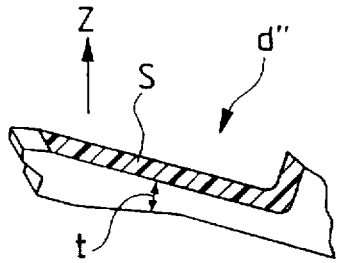
FIG. 9 PRIOR ART
FIG. 9 is a perspective view of a flexible retaining arm for overcoming the problem of nondetection of the half-inserted condition.
Figure 10:
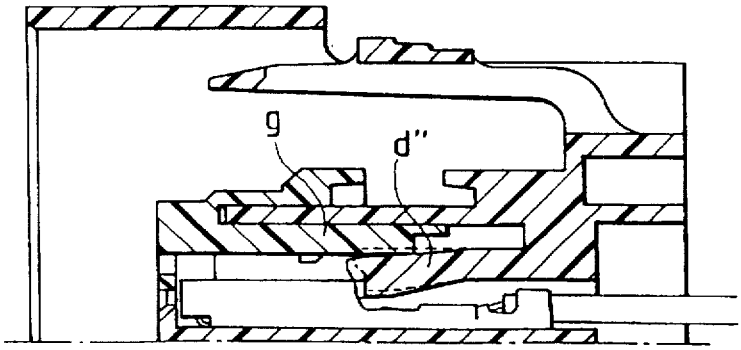
FIG. 10 PRIOR ART
FIG. 10 is a sectional view of the flexible retaining arm of FIG. 9 during operation.

FIGS. 6(A) and 6(B) show a second embodiment of the invention. In the second embodiment, the flexible retaining arm 3 has a tapered releasing portion 3*c*' in place of the stepped-down releasing portion 3*c*. The tapered releasing portion 3*c*' is sloped downward toward the fulcrum of the flexible retaining arm 3 from the terminal pressing portion $3a_2$. A corresponding tapered releasing portion 9*b*' is arranged on the confronting surface of the spacer 9. The tapered releasing portion 9*b*' is sloped upward toward the fulcrum. The operation and advantages obtained by the second embodiment are similar to those of the first embodiment and will, therefore, be omitted.

Figure 11:
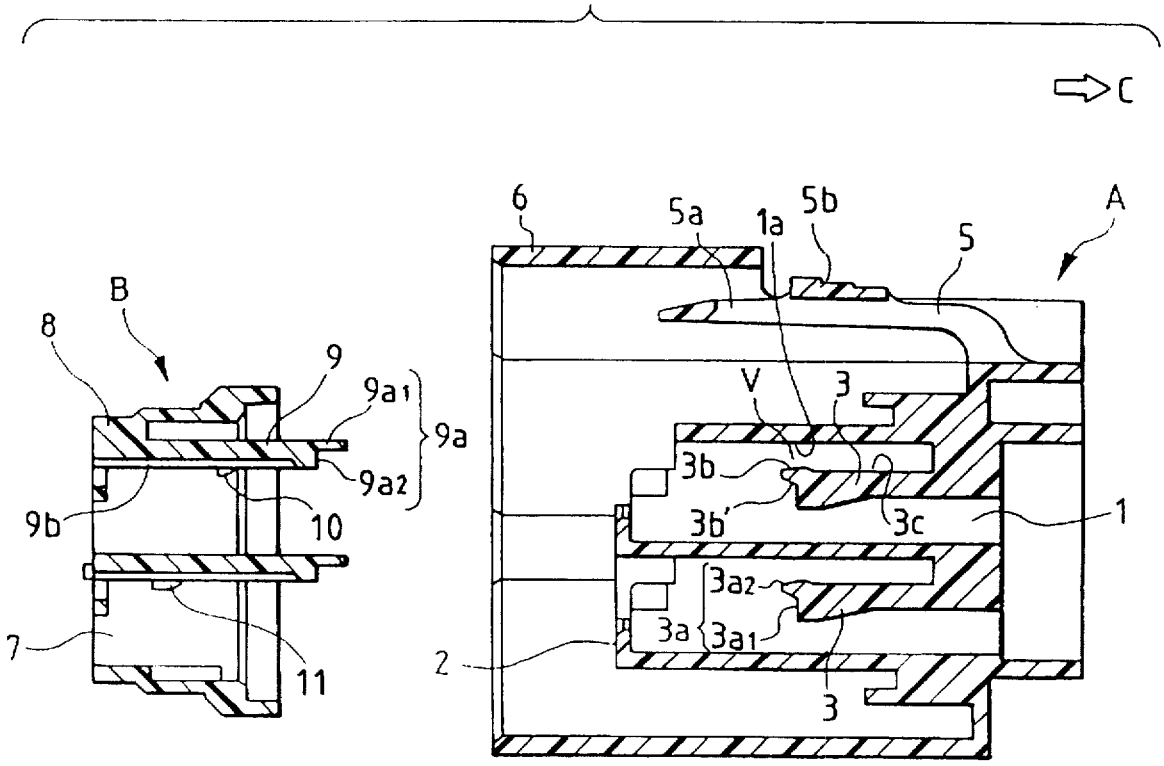
FIG. 11 is a sectional of the male connector housing and the terminal retainer of a third embodiment.

FIG. 11 shows a third embodiment of the present invention. In the third embodiment, a portion between the inner wall surface 1*a* and the flexible retaining arm 3 is omitted as compared with the first embodiment. This structure leads to an increase of product efficiency, it is easy to pull off the cavity from the connector when producing.

As described above, in the present invention, a half-insertion sensing portion releasing portion and a retaining stepped portion releasing portion are provided on the confronting surface of the flexible retaining arm that retains the terminal fitting and on the confronting surface of the spacer, respectively. Therefore, when the terminal retainer is regularly connected, the invention can reliably prevent the terminal fitting from being half-inserted while ensuring stable contact of the terminal without changing the connecting force of the connector.

It will be apparent to those skilled in the art that various modifications and variations can be made in the connector of the present invention without departing from the spirit or scope of the invention. Thus, it is intended that the present invention cover the modifications and variations of this invention provided they come within the scope of the appended claims and their equivalents.

What is claimed is:

1. A connector comprising:

a connector housing including a terminal accommodating chamber configured to receive a terminal fitting and a cantilevered flexible retaining arm extending from an inner wall surface of the terminal accommodating chamber, the flexible retaining arm having a first recessed surface; and a terminal retainer including an insertion portion configured to receive a mating terminal for the terminal fitting and a spacer, the spacer having a second recessed surface, wherein, when the terminal retainer is connected to the connector housing and the terminal fitting is completely inserted into the terminal accommodating chamber, the first and second recessed surfaces are in a confronting relationship to allow for play of the terminal fitting.

2. The connector of claim 1, wherein the first recessed surface is a first stepped recessed surface and wherein the second recessed surface is a second stepped recessed surface.

3. The connector of claim 1, wherein the first recessed surface is a first tapered recessed surface and wherein the second recessed surface is a second tapered recessed surface.

4. The connector of claim 3, wherein the first tapered recessed surface slopes downward from a free end of the flexible retaining arm toward a fulcrum of the flexible retaining arm and wherein the second tapered recessed surface slopes upward from a fixed end of the spacer toward a free end of the spacer.

5. The connector of claim 1, wherein the play is in a direction toward the inner wall surface of the connector housing.

6. The connector of claim 1, wherein a displacement allowing space is defined between the flexible retaining arm and the inner wall surface of the terminal accommodating chamber.

7. The connector of claim 1, wherein the flexible retaining arm includes a terminal retaining portion on a free end thereof.

8. The connector of claim 1, wherein the spacer extends between the inner wall surface and the flexible retaining arm of the connector housing when the terminal retainer is connected to the connector housing and the terminal fitting is completely inserted into the terminal accommodating chamber.

9. The connector of claim 1, wherein the spacer includes a terminal fitting half-insertion sensing portion on a free end thereof.

10. A connector comprising:

a connector housing including a terminal accommodating chamber configured to receive a terminal fitting and a cantilevered flexible retaining arm extending from an inner wall surface of the terminal accommodating chamber, the flexible retaining arm having a confronting surface, the confronting surface having first and second portions;

a terminal retainer including an insertion portion configured to receive a mating terminal for the terminal fitting and a spacer;

wherein when the terminal retainer is connected to the connector housing and the terminal fitting is inserted into the terminal accommodating chamber, the first portion of the confronting surface is spaced further away from the spacer than is the second portion of the confronting surface, to allow for play of the terminal fitting.

* * * * *